United States Patent [19]

Holstein

[11] 4,232,499

[45] Nov. 11, 1980

[54] CAPPER CHUCK

[75] Inventor: John H. Holstein, 5304 N. Colonial - No. 102, Fresno, Calif. 93704

[73] Assignee: John H. Holstein, Fresno, Calif.

[21] Appl. No.: 930,053

[22] Filed: Aug. 1, 1978

[51] Int. Cl.[3] ..... B65B 7/28; B67B 3/20

[52] U.S. Cl. ..... 53/331.5

[58] Field of Search ..... 53/331.5, 317, 306, 53/336, 350, 365, 287

[56] References Cited

U.S. PATENT DOCUMENTS

| | | | |
|---|---|---|---|
| 3,031,822 | 5/1962 | Dimond | 53/331.5 |
| 3,100,366 | 8/1963 | Gordon | 53/331.5 |
| 3,134,211 | 5/1964 | Roberts et al. | 53/331.5 |
| 3,303,633 | 2/1967 | Wilhere | 53/306 |
| 3,805,488 | 4/1974 | Holstein | 53/331.5 |
| 3,852,941 | 12/1974 | Bross | 53/317 |

*Primary Examiner*—Horace M. Culver

*Attorney, Agent, or Firm*—Hill, Van Santen, Steadman, Chiara & Simpson

[57] ABSTRACT

A capper chuck is disclosed for applying a closure cap to a container, the capper chuck having retaining jaws which are adapted to receive and support a closure cap therebetween and have cooperation with an internal torque release lever and torsion spring arrangement operative to release the jaws from the closure cap after a predetermined rotational torque is effected between the closure cap and a container.

17 Claims, 15 Drawing Figures

136
138
142
140
16
146
145
144
126
124
114
10
134
122
133
128
132
2
130
6.
152
48
174
6.
166
154
168
166a
180
164
178
162
158b
158a
158
5.
38
5.
160
36
44
40
20
46
30a
186
150
30
32
4
4
82
182a
80
26
24
110a
108
58b
84
98
112
104
96
100
182
102
184
190
106
188
58
34
90
92
3
78
76
3.
88
68
56
70
62
62
22
72
64
55
64
58a
56a
60a
60b
55
52a
52b
2.
54b
54a
14
12

288
282
284
286
140'
290
114'
146'
292
122'

88
92
90
58
56
34
78
30
76

112
114
46
182
30
32
186
182a

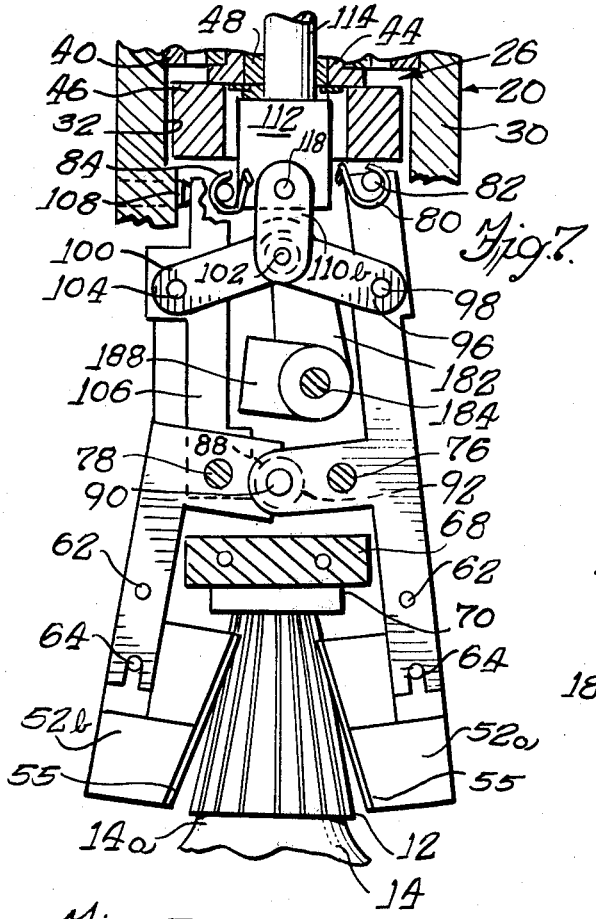
Fig. 7.
Fig. 2.
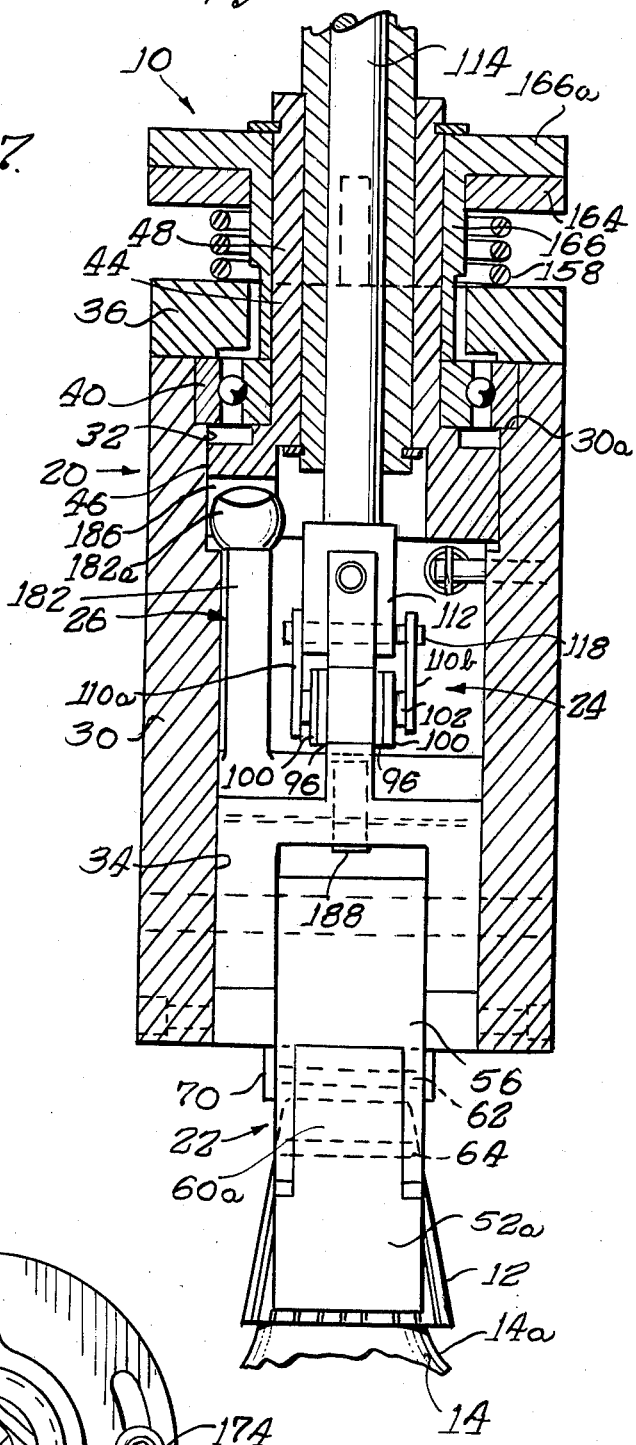
Fig. 5.
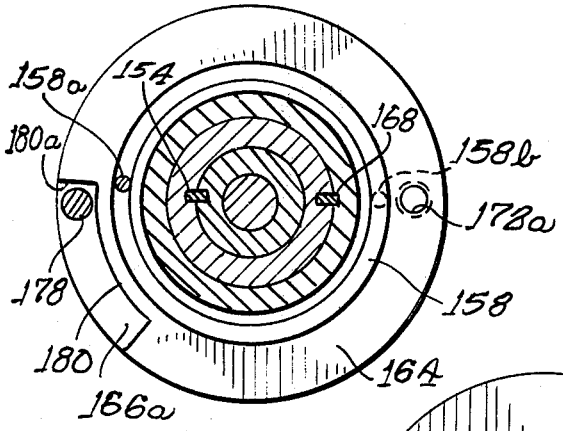
Fig. 6.
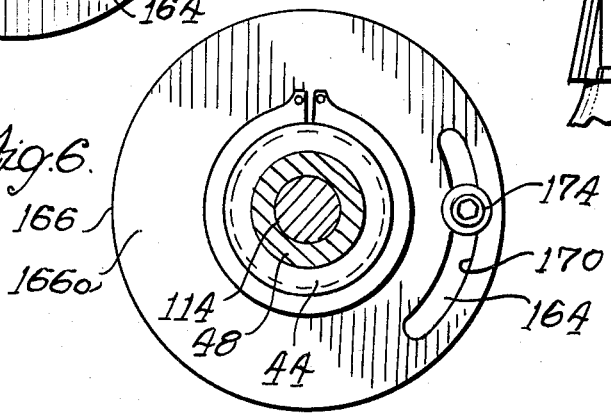

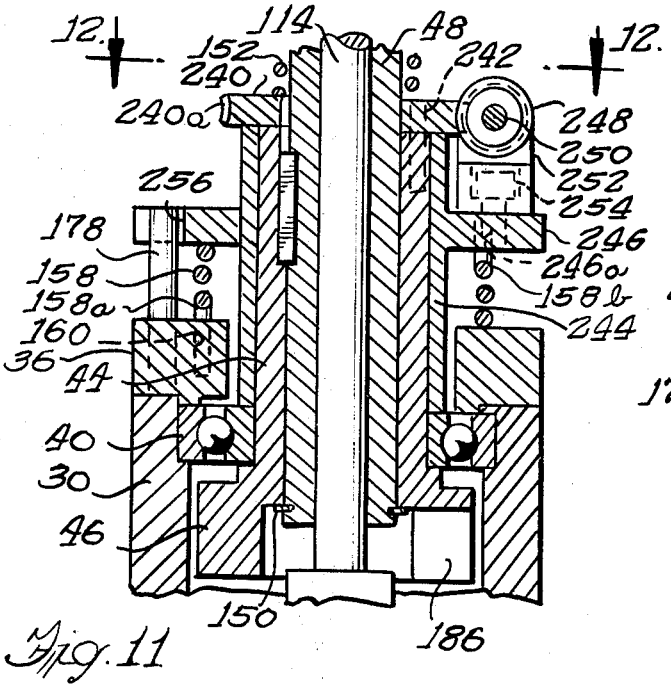
Fig. 11
Fig. 12.
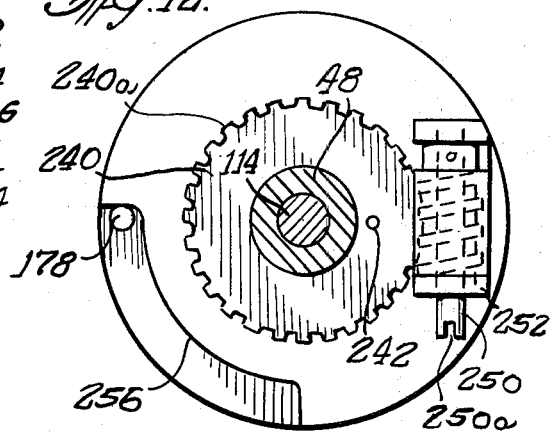
Fig. 14.
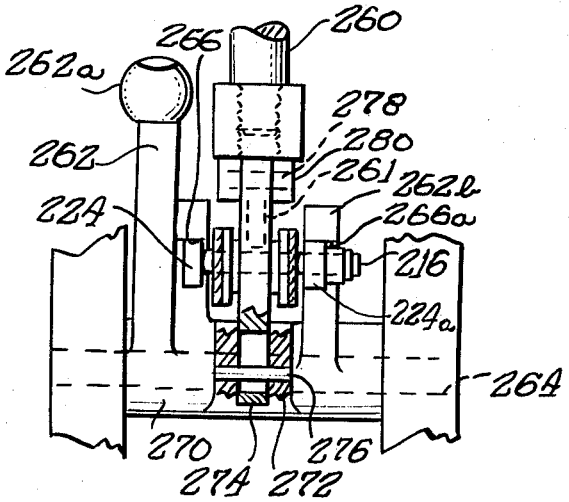
Fig. 13.
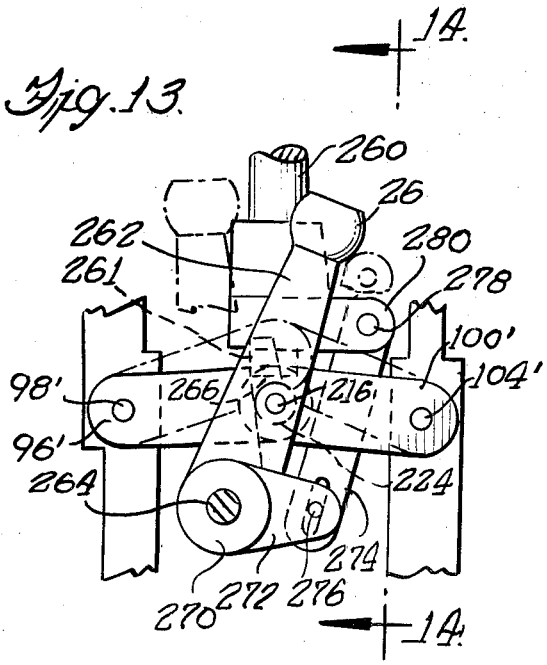

CAPPER CHUCK

The present invention relates generally to apparatus for applying rotatable-type closure caps to containers and the like, and more particularly to an improved capper chuck having novel mechanism for releasing a closure cap in response to a predetermined rotational torque effected between the closure cap and a container onto which the cap is applied.

In applying closure caps to containers wherein the closure caps have threads thereon releasably cooperable with thread conformations on the containers, it is known to mount one or more capper chucks on an endless guide track system so that the chucks move along a reach during which containers are successively brought into axial registration with the chucks, and closure caps carried by the chucks are applied to the containers. The closure caps are carried by gripping jaws which are operative, upon rotation of the associated capper chuck, to tighten the closure cap onto the container until a predetermined torque is effected whereupon the jaws release the closure cap. An example of such a known capper chuck is disclosed in U.S. Pat. No. 3,805,488, dated Apr. 23, 1974.

The capper chuck disclosed in the aforementioned United States patent includes a torque transfer arm which is mounted externally of the chuck housing and is cooperable with the closure cap gripping jaws so that the jaws release the closure cap when a predetermined torque is applied to the closure cap. While capper chucks as disclosed in U.S. Pat. No. 3,805,488 have proved highly effective for their intended purpose, the externally mounted torque transfer arms undergo significant inertia forces during relatively high speed rotation of the capper chucks so that premature release of the closure caps may take place.

One of the primary objects of the present invention is to provide a capper chuck for rotationally applying closure caps to containers, wherein the capper chuck has internally mounted torque transfer elements which substantially reduce rotational inertia forces tending to effect premature release of the closure caps.

A more particular object of the present invention is to provide a capper chuck employing a pair of gripping jaws adapted for movement between open positions operative to receive a closure cap therebetween and closed positions operative to retain the closure cap, the jaws having cooperation with internally mounted control plate means and actuating lever means operative to effect release of the gripping jaws when the jaws are subjected to a predetermined reaction torque when applying a closure to a container.

Another object of the present invention is to provide a capper chuck having, in one embodiment, means for rotating the capper chuck from an internal drive sleeve, and, in a second embodiment, means for rotatably driving the capper chuck from an external drive rim.

A feature of the capper chuck in accordance with the present invention lies in the interconnection of a pair of closure gripping jaws through a sliding connection so that pivotal movement of either of the jaws relative to the capper chuck housing effects a simultaneous opposite pivotal movement of the other of the gripping jaws.

Another feature of the capper chuck in accordance with the present invention lies in the provision of closure gripping jaws having replaceable elements thereon which facilitate adaption of the capper chuck for use with different size closure caps.

Further objects, features and advantages of the present invention, together with the organization and manner of operation thereof, will become apparent from the following detailed description of the invention when taken in conjunction with the accompanying drawings wherein like reference numerals designate like elements throughout the several views, and wherein:

FIG. 2 is a fragmentary longitudinal sectional view of the capper chuck of FIG. 1, taken generally along the line 2—2 of FIG. 1 and looking in the direction of the arrows;

FIG. 5 is a transverse sectional view taken substantially along the line 5—5 of FIG. 1, looking in the direction of the arrows;

FIG. 6 is a transverse sectional view taken substantially along the line 6—6 of FIG. 1, looking at the top surface of the torque plate;

FIG. 7 is a fragmentary longitudinal sectional view of the capper chuck of FIG. 1 showing the gripper jaws released from the associated closure cap;

FIG. 11 is a fragmentary longitudinal sectional view of alternative means for adjusting the torque at which the gripper jaws release an associated closure cap during application to a container;

FIG. 12 is a fragmentary transverse sectional view taken substantially along line 12—12 of FIG. 11, looking in the direction of the arrows;

FIG. 13 is a fragmentary view similar to FIG. 9 illustrating an alternative arrangement for releasably retaining the gripper jaws in closed positions until a predetermined torque is effected between a closure cap and container on which the cap is being applied;

FIG. 14 is a fragmentary sectional view taken substantially along line 14—14 of FIG. 13, looking in the direction of the arrows.

Figure 1:
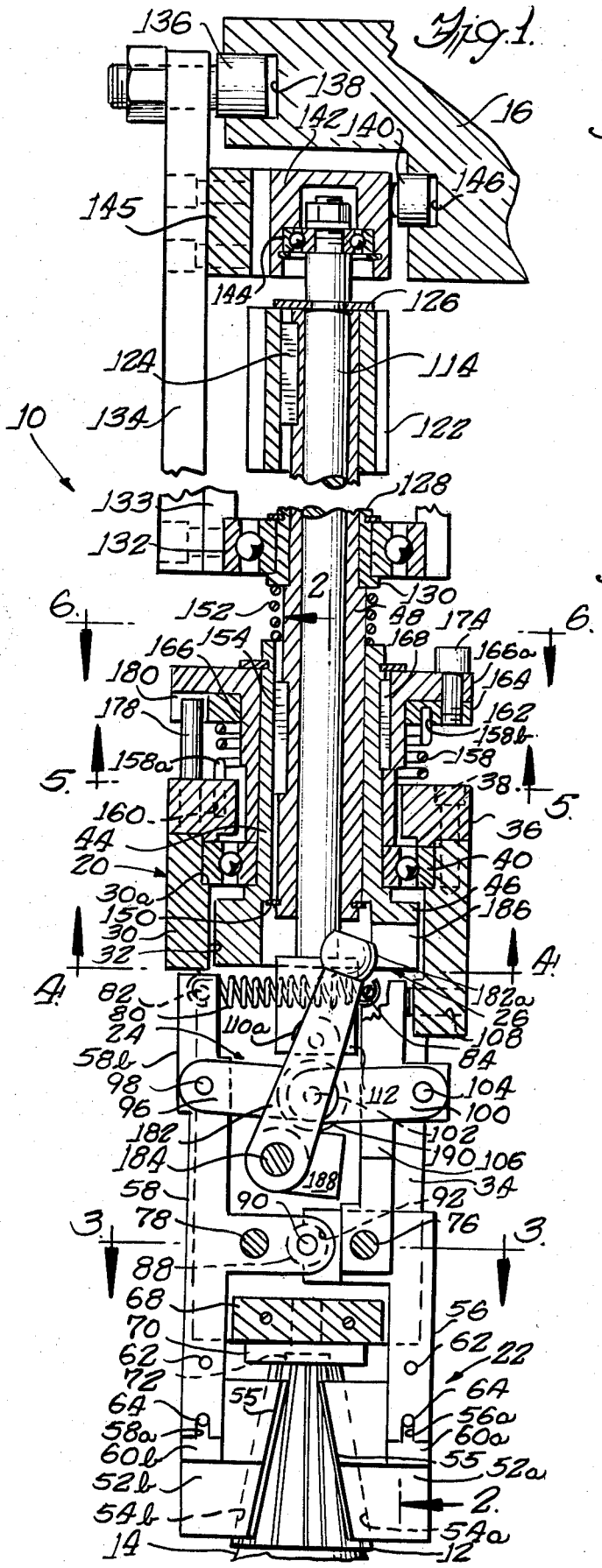
FIG. 1 is a fragmentary longitudinal sectional view of a capper chuck constructed in accordance with one embodiment of the present invention.

Referring now to the drawings, and in particular to FIGS. 1 and 2, a capper chuck constructed in accordance with one embodiment of the present invention is indicated generally at 10. The capper chuck 10 is of the type adapted to rotatably apply a closure cap 12 to a container, a portion of which is indicated at 14. Conventionally, closure caps of the type applied by the capper that movement of the toggle links 96 and 100 to an over-center position, as shown in FIG. 1, closes the gripper jaws to retain the closure cap 12 therebetween. By "over-center" is meant movement of the axis of the connecting pin 102 from a position disposed above a plane containing the pivot axes 98 and 104 downwardly through such plane to a position disposed slightly below such plane, or "over-center" in respect to the plane containing the pivot axes 98 and 104. To effect such movement of the toggle links 96 and 100, the connecting pin 102 is connected through a pair of links 110*a, b* to a connecting block 112 suitably secured to the lower end of an actuating shaft 114 the axis of which coincides with the axis of the housing 30 and intersects the axis of the connecting pin 102. The links 110*a* and 110*b* are pivotally connected to the connecting block 112 through a pivot pin 118. With this arrangement, it will be appreciated that downward axial movement of the actuating shaft 114 relative to the housing 30, as considered in FIG. 7, will effect closing of the gripper jaws 52*a, b*, while a reverse or upward movement of the actuating shaft relative to the housing 30 from its lower position will again open the gripper jaws.

As aforementioned, the capper chuck housing 30 is supported on and rotatable about the support sleeve 48. In the embodiment illustrated in FIGS. 1–7, a drive pinion 122 is fixed on the upper end of the support sleeve 48 through a slot and key 124 connection therewith. The pinion 122 is fixed longitudinally on the support sleeve 48 between an upper retaining ring 126 and the upper end of a secondary support sleeve 128 the opposite end of which engages an annular shoulder surface 130 on the support sleeve 48.

At least one, and preferably two, antifriction bearings 132 are mounted on the sleeve 128 and have their outer races secured within a bearing block 133 fixed to an upstanding support bracket 134. The upper end of the support bracket 134 has a horizontally disposed support roller 136 mounted thereon and received within a cam slot 138 formed within an outer vertical surface of the turret 16. The cam slot 138 defines an endless guide path for the capper chuck and has a predetermined elevational contour adapted to control vertical movement of the support sleeve 48 and capper chuck housing 30 so as to control the vertical position of the gripper jaws 52*a, b* relative to a container 14 as it is moved along a substantially horizontal path in synchronized relation with movement of the capper chuck 10.

As the capper chuck moves along the path defined by the cam groove 138 in the turret 16, axial movement of the actuating shaft 114 relative to the chuck housing 30 is established by an upper horizontal control roller 140 mounted on the upper end of the actuating shaft 114 through a support block 142 and associated bearing 144. The support block 142 is prevented from rotating relative to the actuating shaft 114 by a bifurcated bracket 145 which is secured to the bracket 134 in a manner allowing vertical movement of the support block 142 relative to the bracket 134. The roller 140 is received within a cam groove or slot 146 extending peripherally of the turret 16 and having an elevational contour adapted to effect the desired axial movement of the actuating shaft 114 relative to the chuck housing 30 during a capping operation. Means (not shown) are preferably provided to maintain the capper chuck in desired rotational relation to the turret.

As best seen in FIG. 1, the sleeve 44 and torque release control plate 46 are supported on the lower end of the support sleeve 48 between an annular retaining ring 150 and a coil compression spring 152 captured between the upper end of the sleeve 44 and the lower end of the secondary support sleeve 128. In this manner, the capper chuck housing 30 and the pivotally carried gripper jaws 52*a, b* may move slightly upwardly along the support sleeve 48 should axial downward movement of the capper chuck housing be prevented during a capping operation.

The sleeve 44 and torque release control plate 46 are connected to the support shaft 48 for rotation therewith through a key 154. Rotation of the support sleeve 48 and associated control plate 46, upon rotation of the pinion 122 which may be connected directly or through a gear train to a drive gear (not shown), imparts rotation to the housing 30 and gripper jaws 52*a, b* through a torsion spring 158 cooperative with the control plate and housing to transmit a predetermined rotational torque to the housing.

The torsion spring 158 takes the form of a coil spring coiled about the sleeve 44 coaxial with the longitudinal axis of the capper chuck. One end 158*a* of the torsion spring 158 is affixed within a suitable bore 160 in the bearing retaining plate 36. The opposite end 158*b* of the torsion spring 158 is affixed within a bore 162 in a torque adjusting plate 164 which is releasably secured to the annular flange 166*a* of a reaction member 166 having an annular sleeve portion fixed to the sleeve 44 through a key 168. With particular reference to FIGS. 5 and 6, the reaction member 166 has an arcuate shaped slot 170 formed in the flange portion 166*a* and adapted to overlie a tapped bore 172 formed in the torque adjusting plate 164. A screw 174 extends through the slot 170 and is adapted for releasable threaded engagement with the bore 172 so as to affix the torque adjusting plate 164 to the reaction member 166 in predetermined relation therewith. By selectively adjusting the rotational position of the torque adjusting plate 164 relative to the reaction member 166, it will be appreciated that the torsional preload in the torsion spring 158 may be set to a predetermined value.

A stop pin 178 is secured to the bearing retaining cap 36 and extends upwardly into an arcuate recess 180 formed in the torque adjusting plate 164. The arcuate recess 180 is shaped to cooperate with the stop pin 178 and limit rotational movement of the torque adjusting plate 164 and associated reaction member 166 relative to the housing 30. Under a normal pre-load condition of the torsion spring 158, an end surface 180*a* of the recess 180 engages the stop pin 178 as shown in FIG. 5.

Figure 4:
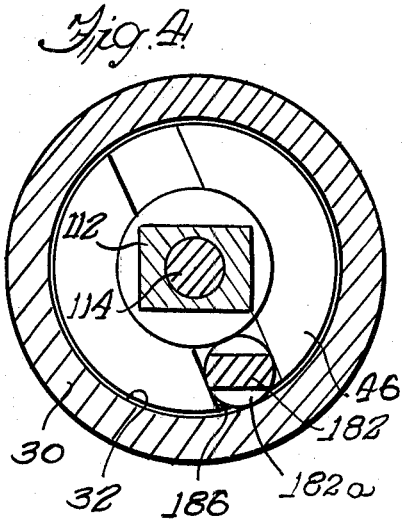
FIG. 4 is a transverse sectional view taken substantially along the line 4—4 of FIG. 1, looking in the direction of the arrows and illustrating the torque release control plate.

To effect release of the gripper jaws 52*a, b* from an associated closure 12 when a predetermined rotational torque is effected between the closure and underlying container 14, the control means 26 includes an actuating lever 182 pivotally mounted on the housing 30 through a pivot shaft 184 disposed transverse to the longitudinal axis of the housing. The actuating lever 182, which may alternatively be termed a trip or release lever, has an upper generally spherically shaped end 182*a* received within a radial slot 186 formed in the torque release control plate 46, as best seen in FIG. 4. The radial slot 186 may extend diametrically of the control plate 46 and slidably captures the upper end 182*a* of the actuating lever 182 so that rotational movement of the control plate effects a corresponding movement of the actuating lever about its pivotal axis 184.

The actuating lever 182 has a lift cam 188 formed integral therewith to underlie a roller 190 supported on the connecting pin 102 between the laterally spaced pairs of toggle links 96 and 100. The lift cam 188 on the actuating lever 182 is positioned so as to be closely proximate or lightly engaged by the roller 190 when the toggle links 96 and 100 are moved downwardly to positions as shown in FIG. 1 wherein the gripper jaws 52*a, b* are closed about the closure 12. With the toggle links 96 and 100 so positioned in their downward over-center positions, and assuming the actuating shaft 114 is free to move upwardly relative to housing 30, it will be appreciated that movement of the actuating lever 182 in a counterclockwise direction about its pivot axis, as considered in FIG. 1, will raise the roller 190 and associated toggle links 96 and 100 upwardly through the plane containing the pivot axes 98 and 104 whereafter the tension spring 80 will assist in a snap-action movement of the toggle links 96 and 100 to open the gripping jaws and release the closure 12.

In the operation of the capper chuck 10, the capper chuck may be moved along the path defined by cam groove 138 in the turret 16 by conventional means (not shown) with the gripper jaws 52*a, b* in their open condition preparatory to receiving a closure cap therebetween. The closure cap may by itself be brought to a position underlying the axis of the capper chuck 10 in synchronized relation with movement of the capper chuck on a synchronized cap supply means such as a button conveyor or a swingable pick-up arm of known design. In either case, the capper chuck is moved downwardly a predetermined distance through cooperation of the support roller 136 with the cam slot 138 to effect engagement of the stop plate 70 with the upper end of the closure. The relationship of the cam slots 138 and 146 is established so that when the stop plate 70 engages the upper end of a closure 12, the actuating shaft 114 is moved downwardly relative to the support sleeve 48 a predetermined distance to move the toggle links 96 and 100 downwardly through their over-center position and effect closing of the gripper jaws 52*a, b* about the closure 12 in gripping relation therewith.

Rotation of the capper chuck through driving rotation of the pinion 122 may be initiated prior to the gripper jaws 52*a, b* being closed on a closure cap 12 or, alternatively, rotation of the capper chuck may be initiated after gripping a closure cap. In either instance, when a closure cap is retained between the gripper jaws 52*a, b* in proper axial alignment with an underlying container 14, rotation of the capper chuck is operative to effect interengagement of the internal thread conformation in the closure 12 with the external thread conformation on the neck portion of the container 14 to apply the closure onto the container.

When a closure 12 being threaded onto an underlying container 14 undergoes a predetermined rotational torque, as established by the selection and preloading of the torsion spring 158, further rotation of the support sleeve 48 relative to the capper chuck housing 30 and gripper jaws will cause the torque release control plate 46 to rotate the actuating lever 182 about its pivot axis 184 and cause the lift cam 188 to raise the roller 190 and associated toggle links 96 and 100 upwardly through the plane containing the pivot axes 98 and 104. As the connecting pin 102 passes upwardly through the plane containing the pivot axes 98 and 104, the tension spring 80 assists in biasing the jaw support arms 56 and 58 and the associated gripper jaws to their open condition whereby to release the closure 12. It will be appreciated that the cam slot 146 is configured to allow such upward movement of the toggle links 96 and 100 to release the closure cap when it is subjected to the predetermined torque.

Figure 8:
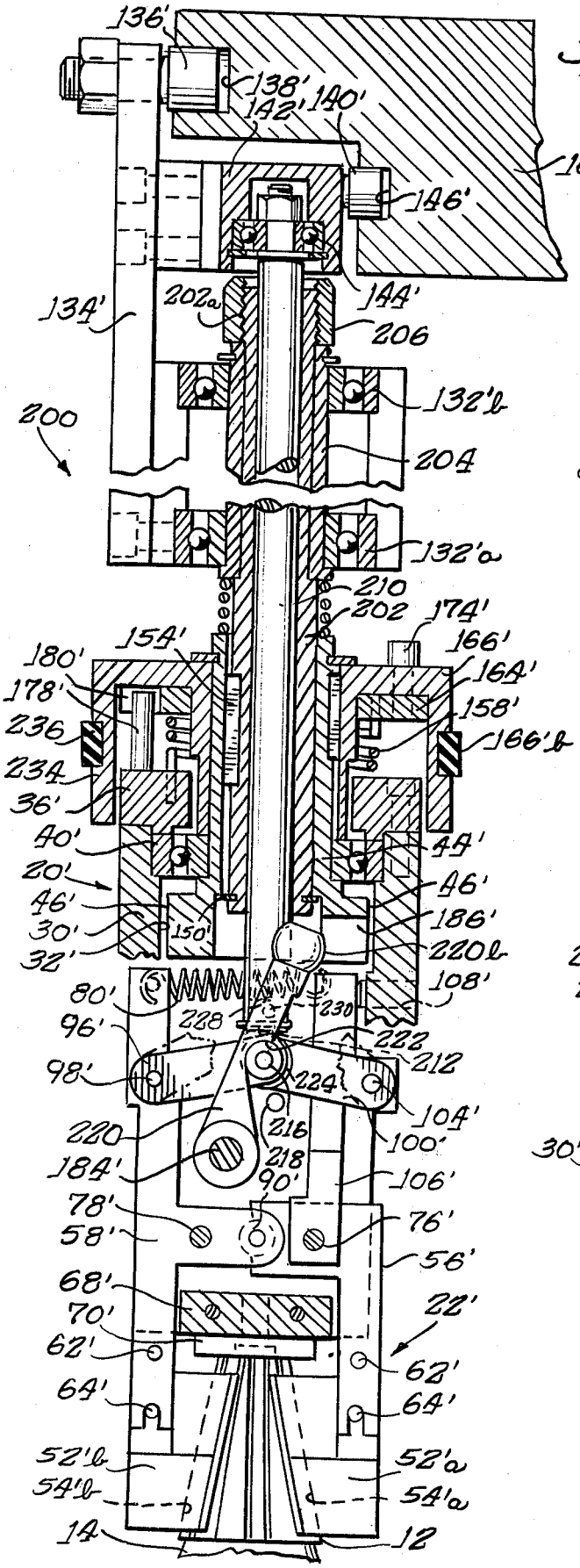
FIG. 8 is a fragmentary longitudinal sectional view of an alternative embodiment of a capper chuck constructed in accordance with the present invention.
Figure 9:
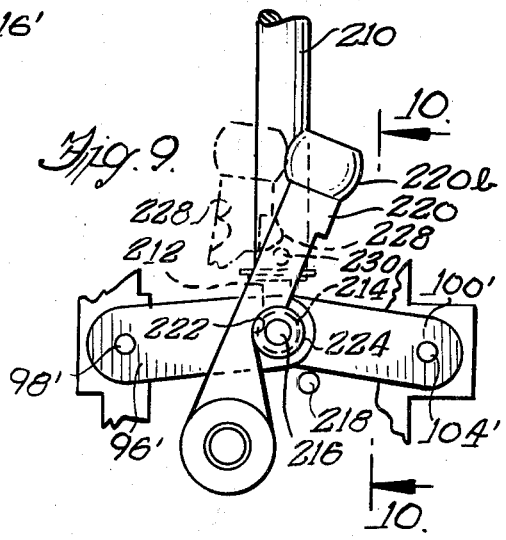
FIG. 9 is a fragmentary view, on an enlarged scale, of the torque release arm of the capper chuck of FIG. 8 shown in solid in its locking position and shown in phantom in its release position.
Figure 10:
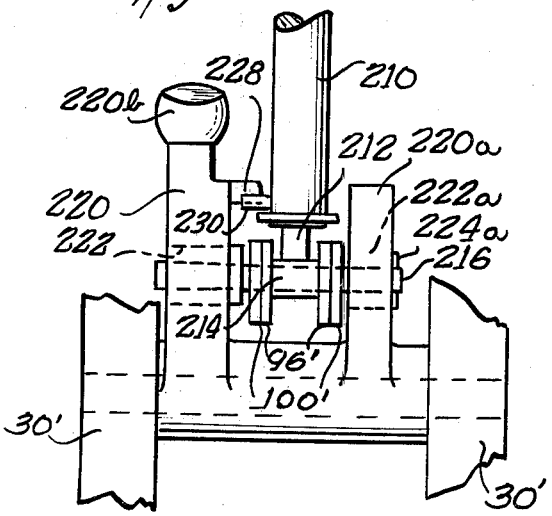
FIG. 10 is a fragmentary sectional view taken generally along line 10—10 of FIG. 9.

FIGS. 8–10 illustrate an alternative embodiment of a capper chuck, indicated generally at 200, constructed in accordance with the present invention. The elements of capper chuck 200 which are similar to corresponding elements in the aforedescribed capper chuck 10 are indicated with corresponding but primed reference numerals. The capper chuck 200 is generally similar to the capper chuck 10 in its ability to apply a closure cap 12 to a container 14 at a predetermined rotational torque.

More particularly, the capper chuck 200 has a support sleeve 202 the lower end of which supports the capper chuck housing 30' through the ball bearing 40', torque release control plate 46' and its associated sleeve 44', and retainer ring 150'. The upper end of the support sleeve 202 has a guide sleeve 204 fixed thereon by a nut 206 having threaded connection with an upper threaded end 202*a* of the support sleeve. The guide sleeve 204 has a pair of longitudinally spaced bearings 132'*a* and 132'*b* fixed thereon, the bearings 132'*a, b* being mounted on a support bracket 134' having an upper support roller 136' received within a cam slot 138' in a turret 16' in similar fashion to support of the aforedescribed capper chuck 10.

An actuating shaft 210 extends through the support sleeve 202 and has a bracket 142' mounted on its upper end for guided relation through roller 140' with a cam slot 146' in the turret 16'. The lower end of the actuating shaft 210 has an actuating block 212 mounted thereon positioned to overlie a roller 214 mounted on a connecting pin 216 which pivotally connects pairs of toggle links 96' and 100' having their opposite ends pivotally connected to the support arm 58 and reaction arm 106' at 98' and 104', respectively. Downward movement of the actuating shaft 210 relative to the support sleeve 202 is operative to engage the block 212 with the roller 214 and move the toggle links 96' and 100' from upper positions, as partially shown in phantom in FIG. 8, to lower positions, as shown in solid lines, to effect closing of the gripper jaws 52'*a, b* onto a closure cap 12' in similar fashion to the aforedescribed capper chuck 10.

It is noted that during closing of the gripper jaws 52'*a, b* onto a closure cap with the capper chuck 200, the toggle links 96' and 100' do not undergo a downward "over-center" movement relative to a plane containing the pivot axes 98' and 104'. Rather, the gripper jaws and toggle links 96' and 100' are configured so that the gripper jaws firmly grip a closure cap of predetermined size before the connecting pin 216 reaches the plane containing axes 98' and 104'. To prevent movement of the toggle links 96' and 100' to a downward over-center position relative to the plane containing the axes 98' and 104', a stop pin 218 is mounted on the housing 30' in position to engage the toggle link 100' and prevent movement of the toggle links to a downward over-center position in case a closure cap is not present between the gripper jaws.

In the aforedescribed capper chuck 10, when the toggle links 96 and 100 are moved to a downward over-center position, the tension spring 80 urges the gripper jaws to closed positions about a closure until a predetermined torque is applied to the closure cap. The toggle links 96' and 100' of capper chuck 200 are maintained in their downward positions effecting gripping of the jaws 56'*a, b* with a closure cap 12' by an actuating lever 220 which is pivotally mounted on the housing 30' through a pivot pin 184'. The actuating lever 220, which may alternatively be termed the torque release arm, has a recess 222 formed therein adapted to receive an annular roller 224 carried on the connecting pin 216 so as to retain the connecting pin 216 and associated toggle links 96' and 100' in their downward positions upon downward movement of the actuating shaft 210 a predetermined distance sufficient to close the jaws **52*a* and 52*b***.

Preferably, the actuating lever 220 has a parallel auxiliary arm **220*a*, as best seen in FIG. 10, having a recess 222*a* formed therein adapted to receive and retain a roller 224*a* supported on the end of connecting pin 216 opposite the roller 224 so as to assist in releasably maintaining the toggle links 96' and 100'** in their downward positions.

The actuating lever 220 has an upper generally spherically shaped end **220*b* disposed within a radial slot 186' in the rotatable torque release control plate 46'. A coil torsion spring 158' is disposed coaxially about the sleeve portion 166'*b* of a rotatable reaction member 166' and interconnects the reaction member 166', and thus control plate 46', to the housing 30' through a torque adjusting plate 164' adjustably secured to the underside of the reaction member 166' through a screw 174' in similar fashion to capper chuck 10. The preloaded torsion spring 158' normally maintains the actuating lever 220 in a position as shown in solid lines in FIG. 8**.

The capper chuck 200 includes means to effect release of the actuating lever 220 from its retaining cooperation with the rolls 224 and **224*a* and thereby open the gripper jaws 52'*a*, *b* in the event that a closure is retained between the jaws but is not applied to a container due to the absence of a properly positioned container, or, alternatively, in the event that the gripper jaws are closed without capturing a closure therebetween. To this end, the actuating lever 220 has a laterally outwardly extending release cam 228 formed integrally thereon which is positioned to be engaged by a laterally outwardly extending release detent or projection 230 formed on the lower end of the actuating shaft 210 during axial upward movement of the actuating shaft from its lower to its upper position relative to the capper chuck housing 30'**.

As best seen in FIGS. 9 and 10, the detent 230 is positioned so that when the actuating shaft 210 is in its lower position, wherein it moves the toggle links 96' and 100' to positions closing the gripper jaws **52'*a*, *b*, the detent 230 is disposed slightly below the cam projection 228. In the event that a container is not in proper registration with a closure cap 12' retained between the gripper jaws 52'*a*, *b*, or in the event that a closure cap is not picked up between the gripper jaws when they are closed so that the jaws are not subjected to a predetermined reaction torque sufficient to release the actuating lever 220 from the rollers 224 and 224*a*, upward movement of the actuating shaft 210 will effect engagement of the detent 230 with the release cam 228 to rotate the actuating lever 220 and release the rollers 224 and 224*a* from their associated recesses 222 and 222*a*, respectively, thereby to allow the tension spring 80' to open the gripper jaws 52'*a*, *b***.

Such upward movement of the actuating shaft 210 is effected by the cam groove 146' which is configured to effect upward movement of the actuating shaft 210 relative to the capper chuck housing 30' at a predetermined time during a capping operation. It will be appreciated that if the capper chuck 200 is employed in a stationary position during application of a closure cap to a container, means other than the cam slot 146' and control roller 140' may be employed to effect the desired axial movement of the actuating shaft 210 relative to the capper chuck housing.

Another difference between the capper chuck 200 and the aforedescribed capper chuck 10 lies in the means for effecting rotation of the capper chuck about its longitudinal axis during application of a closure cap to a container. The capper chuck 200 is illustrated as having an external rim drive rather than an internal gear drive as in the capper chuck 10. To this end, the reaction member 166' has a depending annular rim 234 on which is mounted an annular drive ring 236. The drive ring 236 is preferably made of rubber or the like and is adapted for engagement with an external drive wheel (not shown) or for engagement with a vertically disposed friction plate positioned to be engaged by the drive ring 236 when the capper chuck 200 is moved along a path parallel to the friction plate during application of a closure 12 to an underlying container 14.

FIGS. 11 and 12 illustrate an alternative arrangement for selectively varying the torque at which the gripper jaws will release from an associated closure cap during threading of the closure cap onto a container. Elements of the embodiment illustrated in FIGS. 11 and 12 which correspond to elements of the aforedescribed embodiment illustrated in FIG. 1 are represented by corresponding reference numerals.

In the embodiment of FIGS. 11 and 12, the housing 30 and associated bearing retaining cap 36 are supported on the sleeve portion 44 of the torque release control plate 46 through an annular bearing 40. The sleeve 44 is, in turn, supported on a support sleeve 48 through a retaining ring 150 against which the control plate 44 is urged by a compression spring 152. The upper end of the support sleeve 48 has a drive pinion (not shown) mounted thereon similar to the drive pinion 122 in FIG. 1 to facilitate driving rotation of the support sleeve 48. An annular gear plate 240 is affixed to the upper end of the sleeve 44 through a pin 242 and acts as a reaction member which retains an annular torque adjusting member 244 in coaxial sliding relation on the sleeve 44. The torque adjusting member 244 has a radial flange 246 formed integral therewith which has a bore **246*a* adapted to fixedly receive the end 158*b* of a torsion spring 158, the opposite end 158*a* of the torsion spring being secured within a bore 160 in the bearing retaining cap 36**.

The torque adjusting member 244 is interconnected to the gear plate reaction member 240 through a worm gear 248 mounted on the radial flange 246 for cooperation with teeth **240*a* formed circumferentially of the annular gear plate 240. The worm gear 248 is fixedly mounted on a support shaft 250 which in turn is supported by a bracket 252 secured to the upper surface of the flange 246 as through a screw 254. The shaft 250 preferably has a cross slot 250*a* in one end thereof to facilitate rotation of the shaft and associated worm gear 248 whereby to effect relative movement between the torque adjusting member 244 and the support sleeve 44. The gear plate 240, torque adjusting member 244 and worm gear 248 act as the torque adjusting means for the embodiment of FIGS. 11 and 12. A stop pin 178 is mounted on and extends upwardly from the retaining cap 36 so that the upper end of the stop pin is received within an arcuate slot 256 formed in the radial flange 246 to limit the extent of rotational movement of the torque adjusting member 244 relative to the bearing retainer cap and housing 30. In this manner, rotation of the worm gear 248 is operative to vary the torsional preload in the torsion spring 158 and thereby establish a predetermined rotational torque at which the torque release control plate 46 will undergo rotation relative to the housing and effect a corresponding release of the gripper jaws through the actuating lever 182 (not shown in FIG. 11**).

FIGS. 13 and 14 illustrate an alternative arrangement for releasably retaining the gripper jaws of the capper chuck of FIG. 8 in closed positions until a predetermined torque is effected between a closure cap and a container on which the cap is being applied. The arrangement illustrated in FIGS. 13 and 14 is also operative to release the gripper jaws and move the gripper jaw support arms to open positions in the event a closure cap has not been previously picked up by the gripper jaws, or in the event a closure cap was picked up by the gripper jaws but was not applied to a container due to the absence of a container below the corresponding capper chuck.

In the embodiment illustrated in FIGS. 13 and 14, an axial actuating shaft 260 is operative to move the toggle links 96' and 100' downwardly through engagement of an actuating block 261 on the actuating shaft with a roller 214 carried on a connecting pin 216 interconnecting the toggle links so as to close the associated gripper jaws (not shown) in similar fashion to operation of the actuating shaft 210 in the embodiment of FIGS. 8–10. An actuating lever 262 having a configuration generally similar to the aforedescribed actuating lever 220 is pivotally mounted on a pivot shaft 264 supported transversely on the housing 30'. The actuating lever 262 has a recess 266 formed therein similar to the recess 222 and adapted to receive an annular roller 224 carried on the connecting pin 216 so as to maintain the toggle links 96' and 100' in their downward positions.

The upper end of the actuating arm 262 has a spherical-like knob **262*a* formed thereon which has operative association with a torque release control plate (not shown) such as the aforedescribed control plate 46' in similar fashion to the aforedescribed actuating lever 220. The actuating lever 262 is formed integral with a sleeve 270 which is pivotally mounted on the pivot shaft 264 and has a bifurcated arm 272 formed thereon. The arm 272 has lost-motion connection with a connecting link 274 through a connecting pin 276 secured on arm 272. The opposite end of link 274 is pivotally connected at 278 to an arm 280 on the actuating block 261. Preferably, a second actuating lever 262*b* is also formed integral on sleeve 270 parallel to the lever 262 and has a recess 266*a* formed therein adapted to receive a roller 224*a* mounted on the connecting pin 216**.

In the operation of the embodiment illustrated in FIGS. 13 and 14, the actuating shaft 260, which is operatively associated with a control roller such as indicated at 140' in FIG. 8, is moved axially downwardly relative to housing 30' so as to actuate the toggle links 96' and 100' and close the gripper jaws at a position where it is desired to pick up a closure cap preparatory to applying the closure cap to a container. Should the gripper jaws and associated gripper jaw support arms be moved to closed positions without a closure cap being firmly grasped therebetween, further movement of the capper chuck along its path to a position slightly beyond the position where the capper chuck would normally have applied a closure cap to a container will cause a safety or auxiliary cam (not shown) to act on the actuating shaft 260 and move it axially upwardly relative to housing 30' so as to move the connecting link 274 upwardly and effect pivotal movement of the sleeve 270 and actuating lever arms 262 and **262*a* so as to release the rollers 224 and 224*a*, thus allowing the gripper jaws to move to open positions through operation of spring means such as illustrated at 80' in FIG. 8**. In this manner, the gripper jaws are opened to prepare them for a subsequent capping operation where they will again be closed to pick up a closure cap therebetween.

By providing a lost-motion connection between linkage 274 and the bifurcated arm 272, the actuating shaft 260 may undergo limited upward movement without releasing the rollers 224 and **224*a*. This facilitates pivotal movement of the actuating levers 262 and 262*a* through the operation of the associated torque release control plate 46' (not shown in FIGS. 13 and 14**) when a predetermined rotational torque is applied to a closure cap in applying it to a container in the normal mode of operation.

Figure 15:
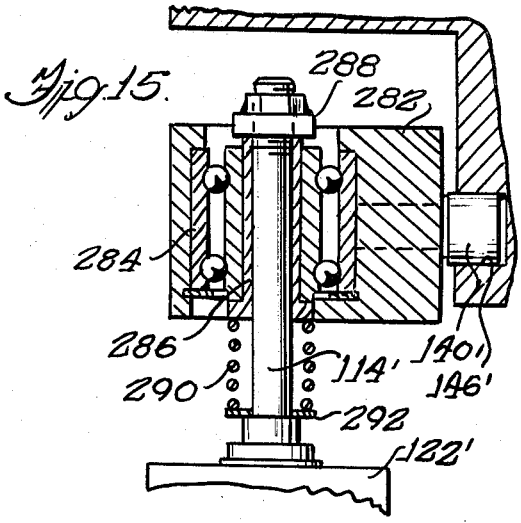
FIG. 15 is a fragmentary longitudinal sectional view illustrating an alternative manner of mounting the upper end of the capper chuck actuating shaft to enable overtravel during cap pickup without damage to the capper chuck.
Figure 3:
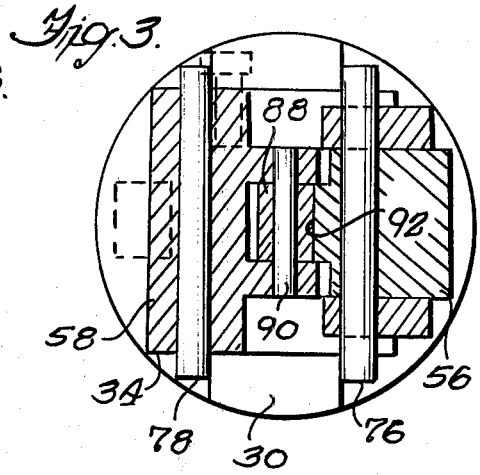
FIG. 3 is a transverse sectional view taken substantially along the line 3—3 of FIG. 1, looking in the direction of the arrows.

FIG. 15 illustrates an alternative manner of mounting the upper ends of the actuating shafts 114, 210 and 260 illustrated in FIGS. 1, 8 and 14, respectively, so as to accommodate downward movement of the corresponding upper support bearing 144, 144' and associated support blocks 142, 142' relative to the actuating shafts without moving the actuating shafts downwardly. This provides for accommodation of overtravel should a corresponding downward movement of the actuating shaft be prevented during a cap pick-up operation. As illustrated in FIG. 15, the upper end of an actuating shaft is indicated at 114' and has a support block 282 mounted thereon through a bearing 284 and sleeve 286. The sleeve 286 is axially slidable on shaft 114' between an upper nut 288 and a coil compression spring 290 seated against a retainer ring 292. In this manner, if downward axial movement of the shaft 114' is prevented during cap pick up, downward movement or overtravel of the support block 282 and control roller 140' in cam slot 146' may be accommodated without exerting potentially damaging forces on the capper chuck components carried on the actuating shaft 114'.

Thus, in accordance with the present invention, it is seen that a capper chuck is provided which is adapted to apply a closure to a container to a predetermined torque whereupon gripper jaws pivotally carried by the capper chuck housing are caused to release the closure without damage to the closure or underlying container. The torque at which the gripper jaws release the associated closure may be varied as desired and is established by a coil torsion spring disposed coaxially of the capper chuck housing and internally of the outer generally cylindrical envelope thereof. With the capper chuck construction of the present invention, the actuating levers 182 and 220 are mounted internally of the capper chuck housing so that minimal inertia forces are established in the actuating levers during relatively high speed rotation of the associated capper chucks. In similar known prior art capper chucks, inertia forces are created during relatively high speed rotation of the capper chucks which may reach sufficient magnitude to effect premature release of closure gripping jaws.

An additional feature of the capper chuck in accordance with the present invention lies in its adaptability for either an internal rotational drive, as through the pinion drive gear 122 illustrated in FIGS. 1–7, or by an external drive as through the drive ring 236. Still further, the gripper jaws are of a construction to facilitate ready replacement with jaws of different configurations whereby to accommodate different size and shape closures.

While preferred embodiments of the present invention have been illustrated and described, it will be understood to those skilled in the art that changes and modifications may be made therein without departing from the invention in its broader aspects.

Various features of the invention are defined in the following claims.

What is claimed is:

1. In a capper chuck for applying a closure to a container by effecting relative rotation between the closure and the container, the capper chuck including housing means, gripper jaw means supported by said housing means for movement between an open condition adapted to receive a closure therein and a closed condition adapted to firmly retain the closure, linkage means interconnecting said gripper jaw means and operable to effect movement of said jaw means between said open and closed conditions, and control means mounted on said housing means and operatively associated with said linkage means to release said gripper jaw means from a closure in response to a predetermined rotational torque effected between the closure and an associated container upon relative rotation between the capper chuck and container, the improvement wherein said control means includes control plate means rotatably mounted on said housing means, coaxial with said capper chuck, spring means coaxial with said control plate and connected between said control plate means and said housing means and operative to transmit a predetermined rotational torque to said housing means upon rotation of said control plate means, and an actuating lever mounted on said housing means for cooperation with said control plate means and said linkage means, said control plate means and actuating lever being operative to effect release of said jaw means from a closure when said predetermined torque is effected between said closure and associated container.

2. The improvement as defined in claim 1 wherein said control means includes torque plate means drivingly connected between said control plate means and said spring means, said torque plate means being adjustable to selectively vary said predetermined rotational torque effected between said closure and associated container upon rotation of said control plate means.

3. The improvement as defined in claim 2 wherein said torque plate means includes a torque adjusting plate and a reaction member, said reaction member having fixed relation to said control plate means for rotation therewith, said torque adjusting plate being adjustably secured to said reaction member and having connection to said spring means in a manner to facilitate selective torsional preload of said spring means.

4. The improvement as defined in claim 1 wherein said housing means defines a longitudinal axis of said capper chuck, said control plate means being coaxial with and rotatable about said longitudinal axis relative to said housing means, said actuating lever being mounted on said housing means and having contact with said control plate means and said linkage means so that rotation of said control plate means relative to said housing means in the direction to apply a closure to a container effects movement of said actuating lever to release said gripper jaw means from a closure retained therebetween when said predetermined torque is between said closure and associated container.

5. The improvement as defined in claim 4 including an actuating shaft disposed axially of said housing means and longitudinally movable relative to said housing means, said actuating shaft having cooperation with said linkage means and being adapted to effect movement thereof between said first and second conditions upon axial movement of said actuating shaft relative to said housing means.

6. The improvement as defined in claim 5 including a support sleeve coaxial with said actuating shaft and rotatable relative thereto, said housing means being supported on said support sleeve for rotation relative to said support sleeve about the axis of said actuating shaft, said control plate means being mounted on said support sleeve for rotation therewith, said spring means being interposed between said control plate means and said housing means and operative to prevent relative rotation therebetween until said jaw means is subjected to said predetermined torque whereupon said spring means facilitates relative movement between said housing means and said control plate means so as to effect movement of said jaw means to said open condition.

7. The improvement as defined in claim 6 including torque plate means mounted on said support sleeve for rotation therewith, said spring means comprising a coil spring substantially coaxial with said support sleeve and interconnecting said torque plate means and said housing means, said torque plate means being adjustable to selectively vary said predetermined torque at which said jaw means are caused to release a closure retained thereby.

8. The improvement as defined in claim 1 wherein said gripper jaw means includes interchangeable closure engaging gripper jaws facilitating adaption of said capper chuck for different size closures.

9. The improvement as defined in claim 1 wherein said housing means defines a longitudinal axis of said capper chuck, said actuating lever having a first portion adapted for cooperation with said linkage means and having a second portion extending generally longitudinally of said housing, said control plate means comprising a control plate mounted on said housing means in coaxial relation therewith and having cooperation with said second portion of said actuating lever so as to effect movement thereof to move said linkage means to said second condition to open said gripper jaw means when said predetermined torque is effected.

10. The improvement of claim 1 wherein said gripper jaw means includes a pair of gripper jaw support arms pivotally mounted on said housing means and movable between pivotally spaced positions defining said open and closed conditions, said gripper jaw support arms being interconnected through a sliding connection such that movement of either of said gripper jaws effects a simultaneous opposite pivotal movement of the other of said gripper jaws.

11. The improvement as defined in claim 1 wherein said linkage means are operable between first and second positions effecting movement of said jaw means between said open and closed conditions, and including an actuating shaft disposed substantially axially of said housing means and cooperable with said linkage means to effect movement thereof from said first to said second positions, said actuating lever being cooperable with said linkage means to releasably retain said linkage means in said second position when moved thereto by said actuating shaft, said control plate means being operative to release said actuating lever from said linkage means when said predetermined torque is effected so as to facilitate return of said linkage means to said first positions.

12. The improvement as defined in claim 11 wherein said linkage means has a projection thereon, said actuating lever defining a recess adapted to receive said projection therein and retain said linkage means in said second position when moved thereto by said actuating shaft, said actuating lever being adapted to release said projection from said recess when said predetermined torque is effected.

13. The improvement as defined in claim 1 wherein said linkage means includes pairs of toggle links movable between first positions wherein said gripper jaw means are in said first condition and second positions wherein said gripper jaw means are in said second condition, said linkage means being moved through an over-center condition when moved from said first to said second positions, said actuating lever being adapted to return said toggle links to said first positions when said predetermined torque is effected between a closure and associated container.

14. The improvement as defined in claim 6 including a drive pinion mounted on said support sleeve and adapted to effect rotation of the capper chuck upon driving rotation of said pinion.

15. The improvement as defined in claim 12 wherein said actuating shaft is moved from a first to a second position to effect said movement of said linkage means from its said first to its said second position, said actuating lever having release cam means thereon, said actuating shaft having detent means thereon adapted for engagement with said release cam means when said actuating shaft is moved from its said second to its said first positions so as to release said actuating lever from said linkage means and effect movement of said jaw means to said open condition in the event said jaw means are not moved to said open condition by application of said predetermined torque between a closure and associated container.

16. The improvement as defined in claim 1 wherein said control means includes a reaction member secured to said control plate means, and a torque adjusting member connected to said spring means and having adjustable connection to said reaction member in a manner to selectively vary said predetermined torque at which said jaw means is released from a closure during application of said closure to a container.

17. The improvement as defined in claim 16 wherein said torque adjusting member is connected to said reaction member through worm gear means rotatably adjustable to vary said predetermined release torque.

* * * * *